US010471768B1

(12) United States Patent
Lindsay

(10) Patent No.: US 10,471,768 B1
(45) Date of Patent: Nov. 12, 2019

(54) METHOD OF CONVERTING A BALL VISE INTO A POSITIONING VISE

(71) Applicant: Steven James Lindsay, Kearney, NE (US)

(72) Inventor: Steven James Lindsay, Kearney, NE (US)

( * ) Notice: Subject to any disclaimer, the term of this patent is extended or adjusted under 35 U.S.C. 154(b) by 241 days.

(21) Appl. No.: 15/424,849

(22) Filed: Feb. 5, 2017

(51) Int. Cl.
*B44B 3/06* (2006.01)
*B25B 1/22* (2006.01)
*B25B 1/24* (2006.01)

(52) U.S. Cl.
CPC ..... *B44B 3/065* (2013.01); *B25B 1/22* (2013.01); *B25B 1/2457* (2013.01)

(58) Field of Classification Search
CPC ..... B44B 3/065; B25B 1/2457; B25B 1/22; Y10T 279/1993; Y10T 279/29
See application file for complete search history.

(56) References Cited

U.S. PATENT DOCUMENTS

| | | | |
|---|---|---|---|
| 86,173 A | 1/1869 | Dickenson | |
| 132,127 A | 10/1872 | Wilcox | |
| 269,708 A | 12/1882 | Thompson | |
| 274,242 A | 3/1883 | Plummer | |
| 340,429 A | 4/1886 | Maynard | |
| 420,968 A | 2/1890 | Seaman | |
| 420,969 A | 2/1890 | Seaman | |
| 420,970 A | 2/1890 | Seaman | |
| 481,238 A | 6/1892 | Muehlmatt | |
| 565,425 A | 6/1896 | Donlevy et al. | |
| 790,540 A | 5/1905 | Valentine | |
| 829,771 A | 6/1906 | Francis | |
| 911,667 A | 2/1909 | Muehlmatt | |
| 983,091 A | 1/1911 | Skow et al. | |
| 1,333,432 A | 3/1920 | Maller | |
| 1,397,293 A | 11/1921 | Plummer | |
| 1,555,774 A * | 9/1925 | Thompson | B44B 3/065 81/4 |
| 1,665,819 A | 4/1928 | Plummer | |
| 1,697,117 A | 1/1929 | Hilstad et al. | |
| 1,936,968 A | 11/1933 | Neal | |
| 1,981,253 A | 11/1934 | Schulz | |
| 2,070,025 A | 2/1937 | Phillips | |
| 2,260,995 A | 10/1941 | Kruczek | |
| 2,310,025 A | 2/1943 | Giern et al. | |
| 2,371,435 A | 3/1945 | Galomeau | |
| 3,815,892 A | 6/1974 | Tulk | |
| 4,243,212 A | 1/1981 | Bunyea et al. | |
| 4,306,709 A | 12/1981 | Hurn | |
| 4,352,489 A | 10/1982 | Wagster | |
| 4,702,465 A | 10/1987 | McConnell | |
| 4,744,552 A | 5/1988 | Glaser | |
| 5,224,692 A | 7/1993 | Anderson et al. | |
| 6,071,031 A | 6/2000 | Bailey | |
| 6,698,738 B2 | 3/2004 | Wiebe | |
| 6,978,989 B2 | 12/2005 | Glaser et al. | |
| 7,097,170 B2 | 8/2006 | Glaser et al. | |

(Continued)

*Primary Examiner* — Sarang Afzali
*Assistant Examiner* — Ruth G Hidalgo-Hernandez

(57) ABSTRACT

The invention relates to converting a ball and socket style vise into a positioning vise. Jewelers and hand engravers and metal working artists utilize traditional ball vises for holding and spinning an object that is being worked on. The present invention provides a way to retrofit these traditional ball vises with a linear positioning top portion assembly.

9 Claims, 4 Drawing Sheets

(56) References Cited

U.S. PATENT DOCUMENTS

| | | | |
|---|---|---|---|
| 7,290,760 | B1 | 11/2007 | Lindsay |
| 7,300,043 | B1 | 11/2007 | Lindsay et al. |
| 8,434,750 | B2 | 5/2013 | Yu |

* cited by examiner

METHOD OF CONVERTING A BALL VISE INTO A POSITIONING VISE

BACKGROUND OF THE INVENTION

Field of Invention

The present invention relates to converting a ball vise into a positioning vise, more particularly, a method of converting a engravers ball vise into a positioning vise.

Description of Related Art

The traditional engravers ball vise which has been in existence since the nineteenth century, consists of a ball base resting in a doughnut type cradle. The top half of the ball is made to pivot on a center axis. On top of this are vise jaws. When the engraver, jeweler or craftsman desires to hand engrave an arc on an object that is clamped in the jaws, he simply turns the vise with one hand, while the other hand holds the engraving point on the surface of the object that is being engraved. The location of the rotating object being engraved has a direct affect on the degree of difficulty in engraving an arc. The location of the rotating pivot position depends on where the object is clamped in the jaws of the vise. An arc is easiest to engrave when it has its center location closest to the center pivot position of the rotating vise. Engravers and jewelers therefore become accustomed to unclamping, moving and reclamping the object in the vise jaws many times in the course of a project. Unfortunately, clamping and unclamping to position the object in reference to the vise pivoting location can become a problem since the objects engravers and jewelers work on are often delicate and can be damaged if clamped incorrectly. In addition, a lot of time is used unclamping and clamping. Another example of the need to position a working area of an object in the center of a rotating vise is when delicate hand working operations are executed with a microscope. The microscope is centered over the rotating pivot position of the vise. The field of view through the microscope is limited and in order to keep a particular spot in view, the axis of rotation needs to stay in the center of the field of view of the scope, otherwise the area being viewed will swing out of view when the vise is rotated.

There have come in existence to solve the above describe problem engravers' positioning vises such as U.S. Pat. No. 7,290,760 to Lindsay. While positioning vises like this help the engraver, they are expensive to manufacture and expensive for the end user. A less expensive positioning vise is needed. Since the traditional ball engraving vise that does not allow positioning is less expensive, there are many of them used in the industry. If these vises could be converted to a positioning vise it would be a cost saving for the end user.

BRIEF SUMMARY OF THE INVENTION

It is the object of this invention to provide a method for metal working artists, jewelers and hand engravers to convert their existing traditional rotating ball vise into a positioning and rotating vise. The method is to provide a positioning top portion assembly that can be utilized together with the users' traditional ball vises. This will make it possible for the users to retrofit their existing vise into a positioning vise.

DETAILED DESCRIPTION OF THE INVENTION

Figure 1:
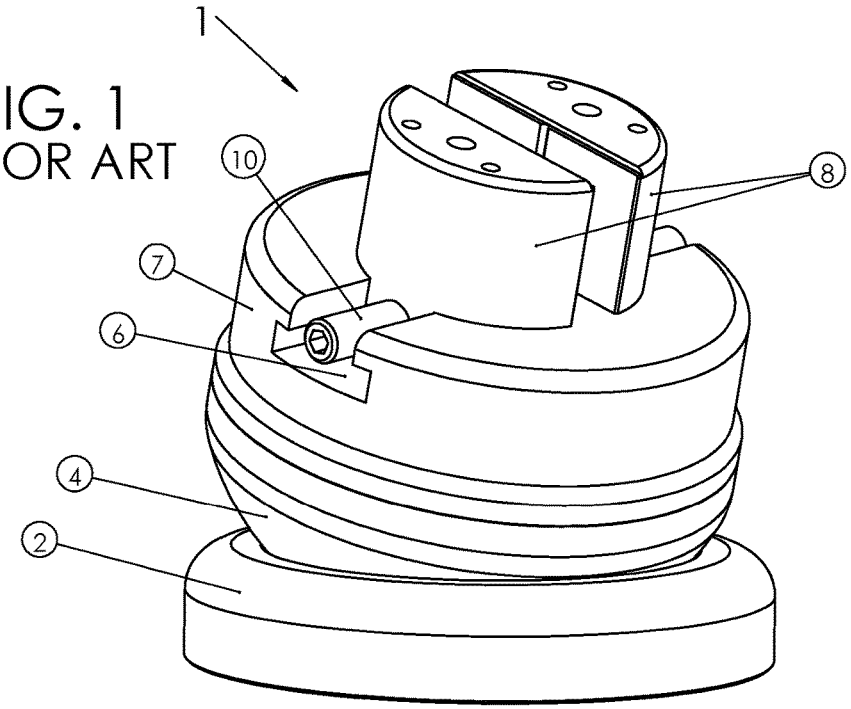
FIG. 1 PRIOR ART
FIG. 1 is an isometric view of a prior art traditional ball vise.

A prior art traditional ball vise 1 is illustrated in FIG. 1 that consists of a cradle 2 that is made to hold ball member 4 so that ball member 4 can be tilted. Above ball member 4 is a rotating block 7 that has a t-slot 6 that is a shape to mate to a portion of jaws 8 for a sliding fit within t-slot 6. Screw 10 has right and left hand threads on either end so that when turned by the user it will open and close jaws 8.

Figure 2:
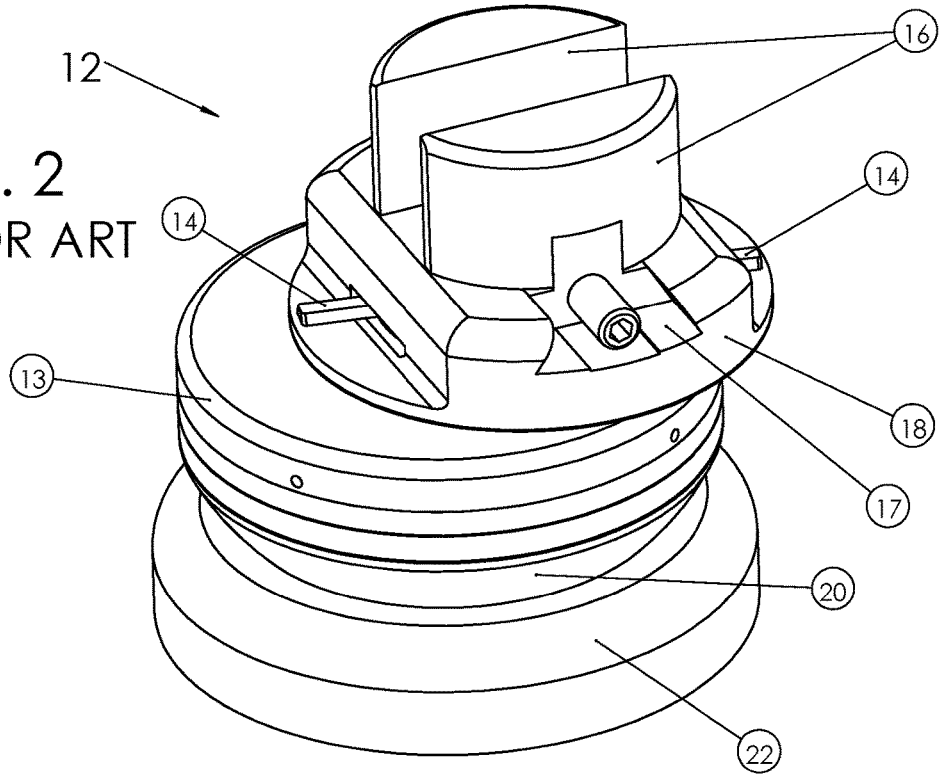
FIG. 2 PRIOR ART
FIG. 2 is an isometric view of a prior art positioning vise having a locking lever that protrudes from both side of the top positioning assembly.

A prior art positioning vise 12 is illustrated in FIG. 2 that consists of a cradle 22 that is made to hold ball member 20 so that ball member 20 can be tilted. Above ball member 20 is a rotating block 13, and above rotating block 13 is sliding jaw support 18 that has a locking lever 14 protruding from two sides of the sliding jaw support 18. In sliding jaw support 18 is a linear undercut slot 17 that happens to be in the shape of a dovetail in this prior art vise. Jaws 16 have a mating shape portion to the linear undercut slot 17 to provide a sliding fit within linear slot 17. The way the top assembly of this and other similar prior art prior positioning vises work is that there is an internal locking mechanism that lever 14 is connected to that will pull sliding jaw support 18 down tight against the top of rotating block 13 and thereby lock it in place on rotating block 13. There are versions of these prior art positioning vises where the lever is spring loaded and thereby keep it normally in the locked position. The user moves the lever 14 to unlock and re-position sliding jaw support 18 where desired in a linear plane on rotating block 13. The user then releases the lever and the spring moves the lever back and locks sliding jaw support 18 in fixed positioning on rotating block 13. There are also other prior art versions where there is a fixed pin protruding next to lever 14. This is so that the user can pinch the pin and lever between the fingers and provide leverage in moving the spring loaded lever. Still another prior art version has lever 14 not spring loaded but allows the user to release the lever without it relocking. The sliding jaw support 18 is then positioned and the lever is moved back manually by the user to lock the top sliding assembly.

Figure 3:
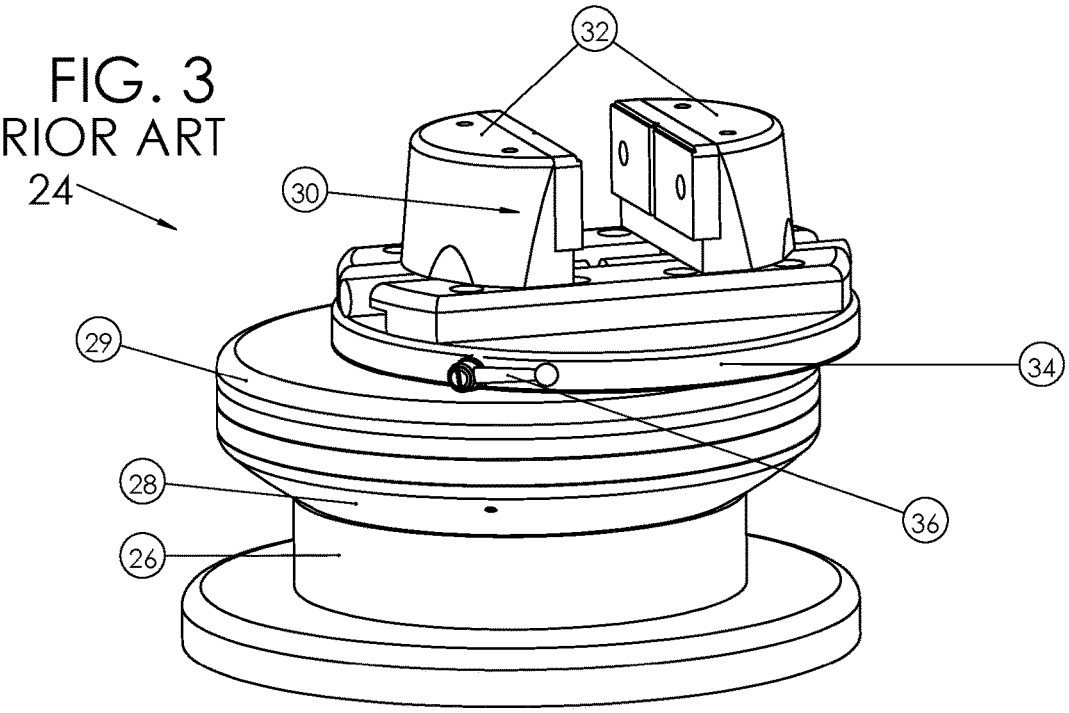
FIG. 3 PRIOR ART
FIG. 3 is an isometric view of a prior art positioning vise having a rotating lever on one side of the top positioning assembly.

FIG. 3 illustrates another prior art positioning vise 24. Although slightly different in some of the shapes to the prior art positioning vise 12 in FIG. 2 they retain similar essential elements such as a cradle 26, ball member 28, rotating block 29, sliding jaw support 34 and jaws 32. The locking handle 36 on this positioning vise utilizes a handle on one side of sliding jaw support 34 that is turned by the user to operate. Internally there a cam shape that the lever rotates that is used to bias sliding jaw support 34 tightly against rotating block 29 to lock the two together.

Figure 4:
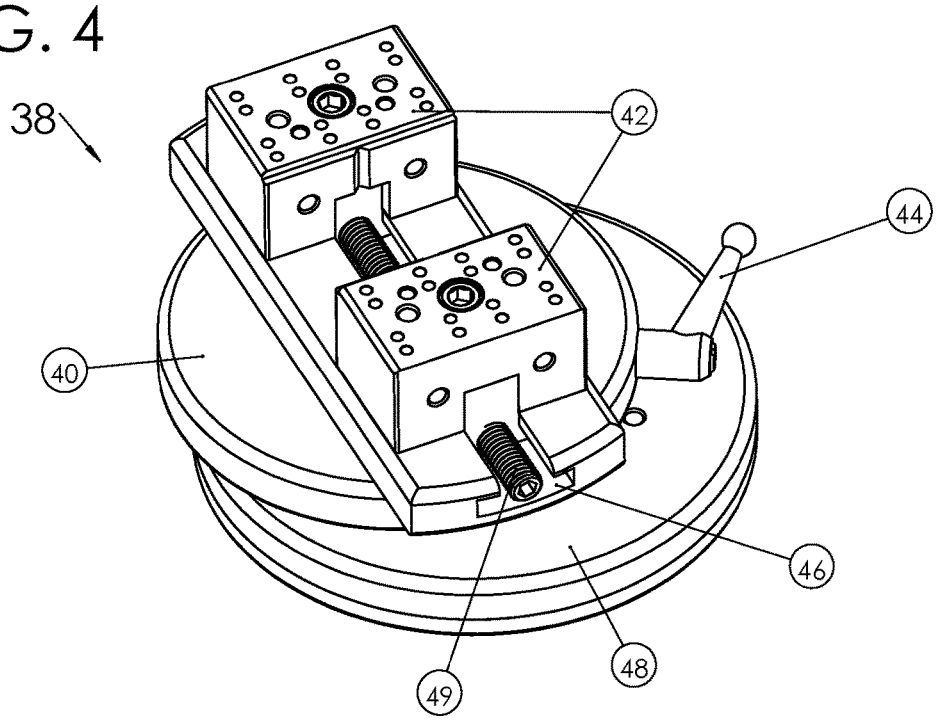
FIG. 4 is an isometric view a top positioning assembly 38 without a rotating and tilting ball base or cradle under it.

FIG. 4 illustrates a top slide positioning assembly 38 that consists of base plate 48, sliding jaw support 40, jaws 42, jaw screw 49, undercut slot 46 and locking lever 44.

Figure 5:
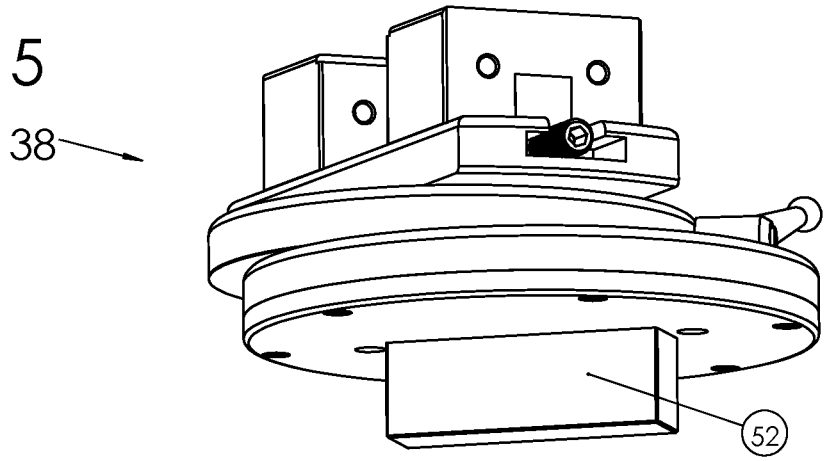
FIG. 5 is an isometric view of the positioning assembly 38 as depicted in FIG. 4, except with a clamping block 52 attached to the bottom.

FIG. 5 Illustrates the same top slide positioning assembly 38 depicted in FIG. 4 but in FIG. 5 the user has attached a clamp block 52 to the bottom of it.

Figure 6:
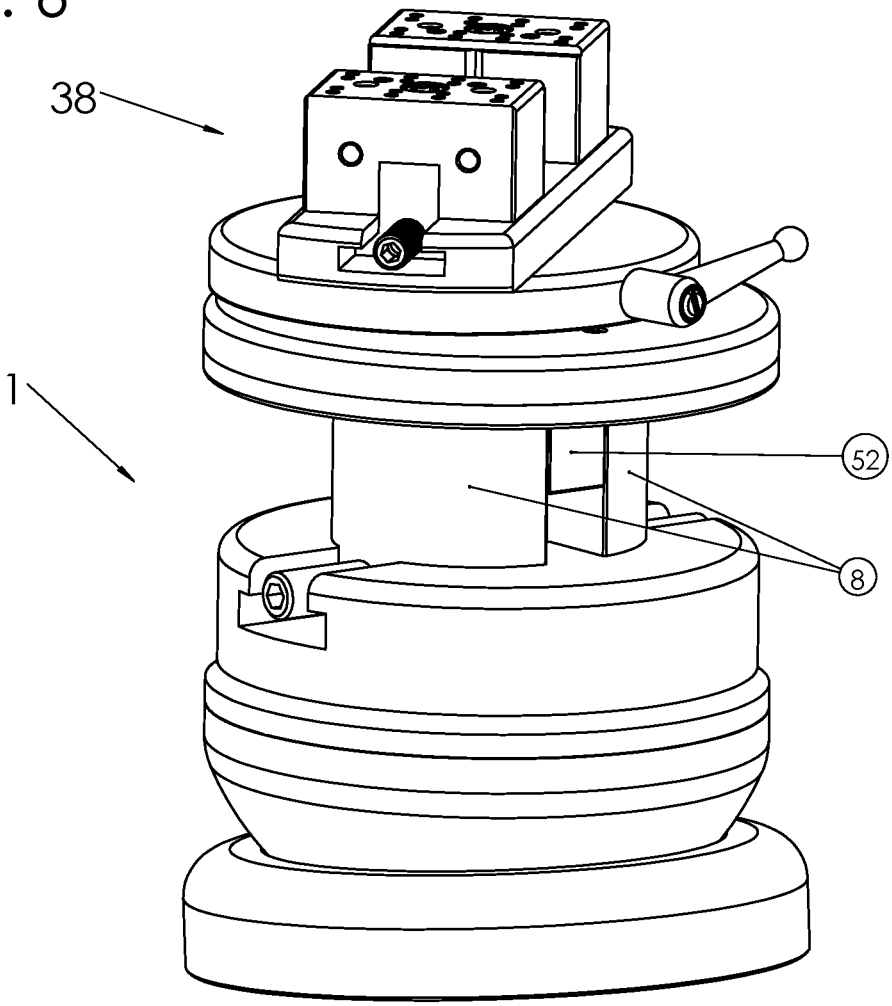
FIG. 6 is an isometric view of the positioning assembly 38 as depicted in FIG. 5 showing it placed into the jaws of the traditional ball vise depicted in FIG. 1.

In accordance to the present invention FIG. 6 illustrates a first method to convert the traditional ball vise 1 illustrated in FIG. 1 into a positioning, rotating and tilting vise. For the conversion a user sets the top slide positioning assembly 38 on top of the jaws of the traditional ball vise 1 and tightens jaws 8 onto the clamp block 52. This allows the user to convert his or her traditional ball into a positioning vise by the use of top slide positioning assembly 38.

Figure 7:
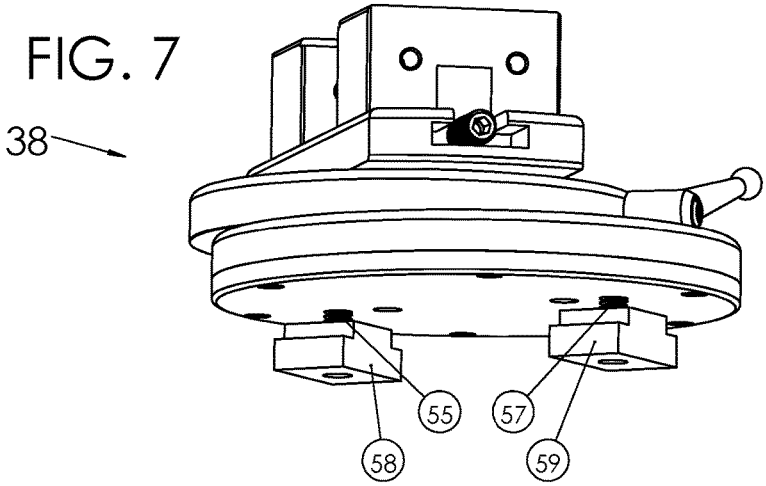
FIG. 7 is an isometric view of the positioning assembly 38 as depicted in FIG. 4, except with t-nuts 58 and 59 on the bottom side.

FIG. 7 illustrates the same top slide positioning assembly 38 depicted in FIG. 4 but in FIG. 7 the user has attached t-nuts 58 and 59 to the bottom of it by the use of bolts 55 and 57.

Figure 8:
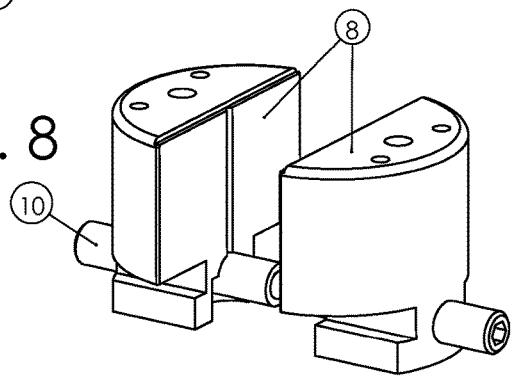
FIG. 8 is an isometric view of the jaws 8 and screw 10 that have been removed from the traditional ball vise that is depicted in FIG. 4.
Figure 9:
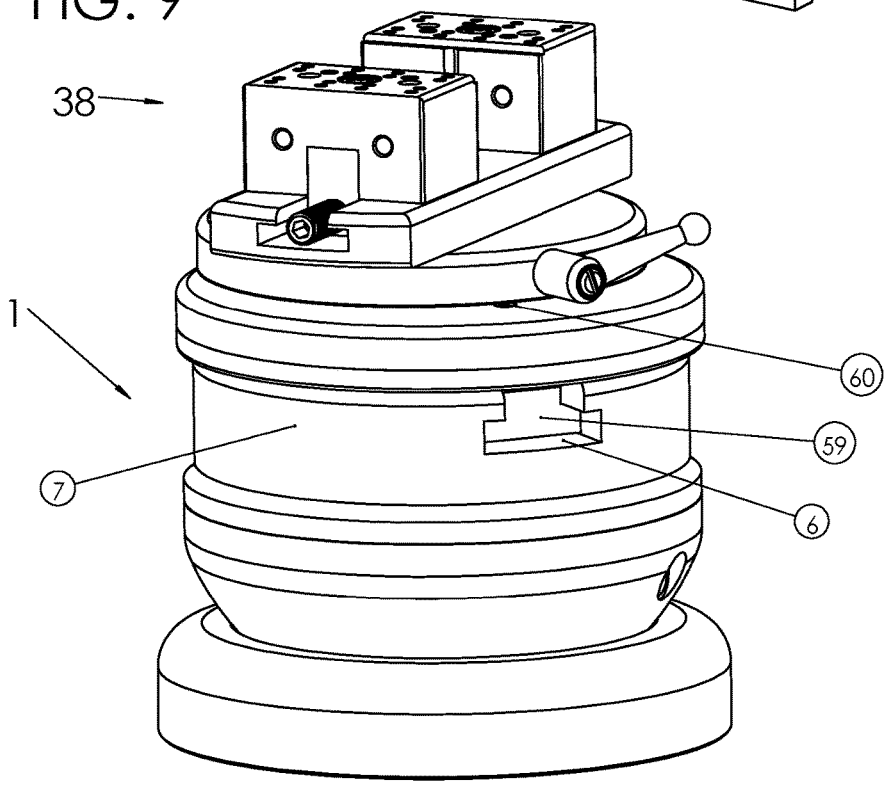
FIG. 9 is an isometric view of the same traditional ball vise depicted in FIG. 4 after the jaws and screw have been removed, and then the positioning assembly 38 has been placed on top and locked down utilizing t-nuts 58 and 59 with t-slot 6.

In accordance to the present invention FIG. 8 and FIG. 9 illustrates the preferred method to convert a traditional ball vise such as illustrated in FIG. 1 into a positioning, rotating and tilting vise. For this preferred method jaws 8 and screw 10 are first removed by the user from the traditional ball vise 1. FIG. 8 illustrates the jaws 8 and screw 10 that have been removed. The user then places top slide positioning assembly 38 on the top of rotating block 7 by sliding t-nuts 58 and 59 into t-slot 6 and with a wrench the user reaches into bolt access hole 60 to the head of bolt 57 to tighten it. The user then moves the sliding jaw support 40 over in order to access a second bolt access hole and tighten bolt 55 into t-nut 58. By first removing the jaws, this preferred method of the invention lowers the overall center of gravity as well as the overall height compared to the first method of the invention illustrated in FIG. 6.

CONCLUSION, RAMIFICATIONS, AND SCOPE

Accordingly, the reader will see that the present invention provides a less expensive option for users by allowing them to retro-fit their current traditional ball vise in order to convert it into a full positioning, tilting and rotating vise. It should be noted to further lower cost, the preferred method described and illustrated in FIG. 7, FIG. 8 and FIG. 9 is that the jaws and screw of the traditional vise (FIG. 8) can be utilized by reusing them in the top slide positioning assembly 38. In other words, if the t-slot made in the top slide positioning assembly 38 were the same size and shape as the t-slot 6 that is in the traditional ball vise 1, the jaws 8 could be reused in the top slide positioning assembly 38.

Although the invention has been described with reference to the various embodiments, it should be noted that equivalents may be employed and substitutions made therein without departing from the scope of the invention as recited in the claims. For example: T-slots are depicted in the illustrated vises except for FIG. 2 that illustrates a dovetail slot. The shape of these undercut slots is not important, in other words, the vise jaws portion that mates to the slot in the vise needs only to be a shape which fits the undercut slot shape that is linear without departing from the present invention.

Accordingly, the scope of the invention should be determined not by the embodiments illustrated, but by the appended claims and their legal equivalents.

I claim:

1. A method of converting a ball vise into a linear plane positioning vise comprising:

providing a ball-and-socket base assembly including:

a cradle, a member having an arcuate portion movably engaged within said cradle, a rotatable block mounted to said member and having a central axis wherein the rotatable block is operable to rotate about said central axis, said rotatable block having a first undercut slot, a first set of vise-jaws having a mating portion for a sliding fit to said first undercut slot, providing a linear plane positioning assembly including:

a base plate, a second plate positioned above said base plate and being slidable on said base plate, said second plate having a second undercut slot, removing said first set of vise-jaws from said first undercut slot and said rotatable block, setting said linear plate positioning assembly against said rotatable block, and securing said base plate to said rotatable block.

2. The method of converting a ball vise into a linear plane positioning vise as recited 1 in claim 1 further comprising: a second set of vise-jaws having a mating portion for a sliding fit to said second undercut slot, and installing said second set of vise-jaws into said second undercut slot.

3. The method of converting a ball vise into a linear plane positioning vise as recited in claim 2 further comprising: a second lead screw for biasing said second set of vise-jaws together.

4. The method of converting a ball vise into a linear plane positioning vise as recited in claim 1 further comprising: installing said first set of vise-jaws that were previously removed from said first undercut slot, and installing them into said second undercut slot.

5. The method of converting a ball vise into a linear plane positioning vise as recited in claim 4 further comprising: a lead screw for biasing said first set of vise-jaws together.

6. The method of converting a ball vise into a linear plane positioning vise as recited in claim 1 wherein the step of securing said base plate to said rotatable block is further defined by a nut that is shaped to fit into said first undercut slot, attaching said nut to a bottom of said linear plane positioning assembly with a bolt, and said nut is slide into said second undercut slot.

7. The method of converting a ball vise into a linear plane positioning vise as recited in claim 6 wherein the step of securing said base plate to said rotatable block is further defined by sliding said second plate to access and tighten said bolt in order to secure said bolt.

8. The method of converting a ball vise into a linear plane positioning vise as recited in claim 1 further comprising: a locking lever for locking said second plate in place on said base plate.

9. The method of converting a ball vise into a linear plane positioning vise as recited in claim 1 wherein the step of securing said base plate to said rotatable block is further defined by utilizing said first undercut slot together with a fastener.

* * * * *